US006248404B1

(12) United States Patent
Greene-Mathis

(10) Patent No.: US 6,248,404 B1
(45) Date of Patent: Jun. 19, 2001

(54) PROCESS FOR PAPER RECLAMATION

(76) Inventor: Mary Virginia Greene-Mathis, 306 Baxter La., Fayetteville, AR (US) 72702

( * ) Notice: Subject to any disclaimer, the term of this patent is extended or adjusted under 35 U.S.C. 154(b) by 0 days.

(21) Appl. No.: 09/379,982

(22) Filed: Aug. 24, 1999

(51) Int. Cl.[7] ..... B05D 3/10

(52) U.S. Cl. ..... 427/336; 427/337; 427/342; 427/444

(58) Field of Search ..... 427/336–342, 427/345, 352, 369, 444; 162/5; 134/10, 15; 536/38, 76

(56) References Cited

U.S. PATENT DOCUMENTS 5,217,573 6/1993 Tsai et al. ..... 162/5
5,362,362 11/1994 Cunningham et al. ..... 162/5
5,364,405 11/1994 Zaleski ..... 606/107
5,540,815 * 7/1996 Igarashi et al. .
5,858,076 1/1999 Thompson ..... 106/217.3
6,022,423 * 2/2000 Bhatia .

* cited by examiner

*Primary Examiner*—Fred Parker
(74) *Attorney, Agent, or Firm*—Head, Johnson & Kachigian

(57) ABSTRACT

The present invention involves a method for altering pre-existing patterns of ink on paper. Used, waste paper is treated such that words, images and pictures are altered to form substantially different and aesthetically pleasing patterns. A chemical activator is applied to waste paper, thereby causing the present ink to diffuse. Optionally, additional inks may be added and further diffused across the paper. Once the treated paper has dried, a new, unique pattern has formed. In this manner, previously unuseable paper becomes suitable for a variety of aesthetic purposes. The resulting paper product may be used for wrapping paper, contact paper, wallpaper or the like.

3 Claims, 1 Drawing Sheet

PROCESS FOR PAPER RECLAMATION

BACKGROUND OF THE INVENTION

1. Field of the Invention

The present invention relates generally to a process for reclaiming waste paper. In particular, the invention relates to a process for altering clay-coated paper for subsequent re-use. More particularly, this invention relates to a process of altering the ink imprinted upon many cellulosic materials and in particular to a process of altering a broad spectrum of printed products including newspaper, laser written paper, xerographic paper, rotogravure, headset, including coated and uncoated stock and particularly gloss multi-colored paper, such as magazines.

2. Prior Art

Conventional methods of reclaiming waste paper have principally involved various processes attempting to completely remove the ink. Many of these processes involved cooking of waste stock in various aqueous deinking chemicals. Such methods were reasonably satisfactory and adequate a number of years ago when there was no need to deink and reclaim waste paper having little or no quantities of ground wood. Such papers were printed with standard inks which are more readily removed or saponified with chemicals at elevated temperatures.

In recent years, however, methods of processing waste paper which involve cooking and the use of chemicals in aqueous media have become increasingly unsatisfactory for a number of reasons. Ink formations have become more and more complex and involve an increasing use of a wide variety of synthetic resins and plasticizers; with each ink having its own special formulation. Also, increasing amounts of synthetic resins and plasticizers were being used in a wide variety of sidings, coatings, plastic binding adhesives, thermoplastic resins and pressure sensitive label adhesives. Furthermore, the use of multicolored printing and multicolored advertisements have become increasingly popular in recent years and these involve a wide variety of new ink formulations. Many of the new ink formulations incorporate new pigments, dyes, and toners which are difficult to remove by conventional aqueous deinking chemicals. The former methods of deinking and reclaiming waste paper by chemical and cooking techniques are not adapted for, or adequate for, removing the new types of inks and coating resins. Due to high contents of thermoplastic resins, the softening action of heat and chemicals alone make their separation from the fibers very difficult. Additionally, the action of heat and chemicals tend to irreversibly set and more firmly bond some of the present day pigments to the fibers and fix dyes and toners to the fibers through staining.

Conventionally, cooking processes for deinking paper have utilized aqueous based suspensions. The stock to be salvaged is first thoroughly cleansed of superficial dirt and then macerated. The maceratum is boiled, subjected to cooking and defiberizing in a suitable aqueous alkali to soften the paper fibers, loosen and dissentegrate at least part of the ink and other matter adhering to the fibers, and thoroughly agitated, whether while in the alkaline solution or subsequently, to disintegrate and defiber the stock as thoroughly as possible. Thereafter, the pulp is riffled and screened and subsequently dewatered, preferably through suitable rolls, filters of the like, to remove a considerable portion of the loosened ink. It is then washed and dewatered for removal of additional quantities of the loosened ink as many times as may be practical and expedient.

In general, conventional deinking agents have employed an aqueous alkali solution which may, in addition, contain one or more of the following: a nonionic detergent, a sodium soap of fatty acids or abietic acid sulfonated oil, a dispersing agent to prevent agglomeration of the pigment after release and to emulsify any unsaponifiably material; a softening agent such as kerosine or mineral oil to soften the vehicle of the inks; an agent such as clay, silicate, etc., for selective absorption of pigments after release from the fiber to prevent redeposition on the fiber; and a basic exchange chemical to prevent formation of calcium soaps.

The cooked and defibered pulp is then diluted to less that 1 percent concentration and riffled and screened to remove oversized objects and undefibered pieces of paper. This material is then washed with large amounts of water, an average of 20,000 gallons of water per ton of pulp, to separate the fiber from other substances by washing or screening or by a flotation process. The disposal of large amounts of water used in such processes pose a stream pollution problem which must be remedied. Various patents have attempted to address this problem, including U.S. Pat. No. 5,362,362. However, such processes still rely upon similar techniques with similar problems. That is completely recycling the entire paper product.

Another area in which conventional processing techniques are unsatisfactory in reclaiming waste paper is in the area of electrophotography, better known as xerography. In the art of xerography, an electrostatic xerographic latent image is formed by uniformly charging a photoconductive insulating surface of a xerographic plate followed by exposing the charged surface to a pattern of light. The latent image formed by this technique is then developed with an electroscopic powder, also known as a toner, to form a powdered image which is then transferred to a sheet of normal bond paper. The powder image contained on the paper is then fused into the paper to form a permanent reproduction of an original image.

Another means of xerographic development is liquid electrophoretic development, which has particularly utility when photoconductive paper is xerographically processed. Developers may be prepared by dispersing finely ground pigments, such as zinc oxide, phthalocynanine blue or nigrosine in an insulating hydrocarbon liquid such as toluene, carbon tetrachloride, or petroleum fractions. The pigment particles acquire electrical charges during dispersion and remain suspended in a liquid. When a photoconductive paper containing an electrostatic image of a polarity opposite to that of the dispersed particles is immersed in the liquid, the pigment particles migrate and become fixed on the latent image.

Laser writing processes also employ various complex dyes and pigments applied to paper by high temperature fusion. These processes are similar in effect to the xerographic processes in that the ink removal is extremely difficult.

Since ever increasing amounts of xerographic and laser written paper are being used each year, effective processes for reclaiming this type of waste paper are very much needed. However, the effectiveness of any process must take into account the fact that development compositions for xerographic and laser writing processes consist of complicated organic compositions fused under high heat to the paper. With regard to toner development, as heretofore indicated, the toner is usually made of fusible resins or resin blends in which a pigment, such as carbon black, has been dispersed. The resins are selected to provide a melting point within the proper range for heat-fixing, or of a sufficient solubility for solvent vapor fixing. In essence, the action of heat and complex organic chemicals in these printing processed yield printed paper having almost irreversibly stained cellulosic fibers.

In the past, nonaqueous processes have been employed that utilize various chemical additives such as surfactants. U.S. Pat. No. 3,072,521, for example, relates to a nonaqueous process of deinking cellulosic materials employing a surfactant-containing organic solvent. The surfactant is necessary to enable removal of ink from the paper.

Other processes that have been developed utilize partial nonaqueous or immiscible solvents. U.S. Pat. No. 3,635,789, describes a deinking process whereby an immiscible solvent is added to an aqueous pulp suspension to facilitate the removal of ink from the pulp. U.S. Pat. No. 3,891,497, relates to a process for recovering of waste paper using steam and immiscible fluids and a small amount of water. The water is added to the waste paper to make it easier to break the bonds between the fibers. The process is conducted in a pulper at an elevated pressure because high temperatures are employed.

U.S. Pat. No. 5,217,573 also details a method of removing laser printer and xerographic toner, ink and the like. However, it also relies upon chopping and shredding the paper for subsequent recycling.

For the above and other reasons, conventional reclamation techniques used for recycling waste paper are no longer as efficient or effective as is desirable for many current needs.

In particular, for many applications, it is not necessary to completely remove ink from paper prior to paper re-use. On the other hand, because of significant potential liability for copyright and/or trademark infringement, it is desirable to alter any preexisting images on the reclaimed paper significantly prior to re-using. This need is not addressed by the known art.

The need for a satisfactory process for altering the ink upon paper to render the paper suitable for re-use has further become increasingly important due to greatly expanded utilization of paper and the increasing difficulty in disposal of the old papers especially due to a projected lack of future landfill sites. In this regard, and to preserve natural resources and minimize environmental problems, the need for developing useful and efficient paper re-using processes becomes of critical importance.

SUMMARY OF THE INVENTION

The present invention involves a method for manipulating the ink on many types of paper and particularly clay-coated paper. The invention is practical in that it reduces waste by keeping magazine paper out of landfills. The method is also more efficient because it enables treated paper to be reused rather than recycled, thereby using less energy. The method is inexpensive and can be either done by individuals, allowing them to participate and to express their creativity, or on a large-scale commercial basis.

The process may be used to create intricate patterns upon the treated pages that render the treated pages suitable for multiple uses. The treated page may be subsequently used for envelopes, collages, stationary, wrapping paper, and the like.

The process uses several steps to substantially obscure and/or alter the printed materials on a page. The steps may be summarized as arranging the materials to be treated, treating the materials and subsequently drying the materials. Optional intermediate steps that may be included after materials treatment include further distortment of any remaining ink on the material, using alternative materials to "blot" the treated material as well as producing additional re-usable pages from optional cross-stream treatments.

During the initial step, the pages are arranged to receive treatment. This step may require a preliminary treatment involving the removal of independent pages from a bound item, such as removing the pages from a magazine or the like. Such preliminary treatments are conventionally known and many conventional tools, such as cutters, collators, and the like are commercially available and perfectly acceptable for use in performing this step. The primary purpose of the arrangement step is to align the materials to be treated such that the paper to be treated is accessible for the subsequent application of an activator.

The treatment step includes the application of an activator to the page and the subsequent alteration of the ink. Ideally, the treatment step includes the use of an organic, biodegradable and non-toxic activator. Other acceptable alternate activators are commercially available but are less desirable for a number of reasons (e.g. toxicity, adverse environmental impact, etc.).

The activator is applied to the arranged materials in a suitable manner. The method of application may include misting, wiping, spraying, etc. The primary concern is that the activator is applied sufficiently to the material to initiate the solubilization of the ink in order to permit subsequent alteration of the ink yet not to saturate the paper fibers.

The alteration of the ink upon the material is accomplished by physically contacting the material with an appropriate tool or blotter to distort and/or disturb the activated and solubilized ink to alter the preexisting image or pattern upon the page.

Tools that may be used include plastic bags, plastic brushes, strings, and the like. The tools are preferably deployed in close proximity to the path of paper after activator application to quickly work upon the surface to be altered. The primary object in the alteration step is to substantially alter the preexisting pattern upon the page so that it is no longer recognizable in its former pattern. In this manner, the paper may be re-used without liability for copyright and/or trademark infringement. The paper is also enhanced in its decorative value as a result of the alteration. In many instances, the activated ink combines to form new and attractive patterns as well. As another optional step, new ink may be added to obtain desirable color schemes.

After the alteration step, an optional cross-stream blotting step can be employed to maximize the use of solubilized ink. In this manner, the ink may be re-used as well, thus preventing additional cost associated with purchasing and printing. This is particularly effective when a second, untreated blank paper (or other sheets with pre-existing patterns) of larger size is pressed against the treated paper to absorb a portion of the solubilized ink.

The drying step permits the treated material to set the solubilized ink to fix the altered pattern or image on the paper. This step can be carried out by either simply setting the page aside for 15–30 minutes to air dry or using conventional air blowers to decrease the requisite time required to dry the ink.

An object of the present invention is to provide an efficient and effective method for reclaiming waste paper.

A related object of the present invention is to provide an environmentally safe alternative to conventional paper reclamation processes.

Another object of the present invention is to provide a process for re-using waste paper.

Yet, another object of the present invention is to provide a method of re-using waste ink.

Another object of the present invention is to provide a process for simultaneously reclaiming waste paper while providing creative paper products.

DETAILED DESCRIPTION OF THE PREFERRED EMBODIMENTS

The present invention involves a method for manipulating the ink on many types of paper and particularly clay-coated paper. The invention is practical in that it reduces waste by keeping magazine paper out of landfills. The method is also more efficient because it enables treated paper to be reused rather than recycled, thereby using less energy. The method is inexpensive and can be either done by individuals, allowing them to participate and to express their creativity, or on a large-scale commercial basis.

The process may be used to create intricate patterns upon the treated pages that render the treated pages suitable for multiple uses. The treated page may be subsequently used for envelopes, collages, stationary, wrapping paper, and the like.

Figure 1:
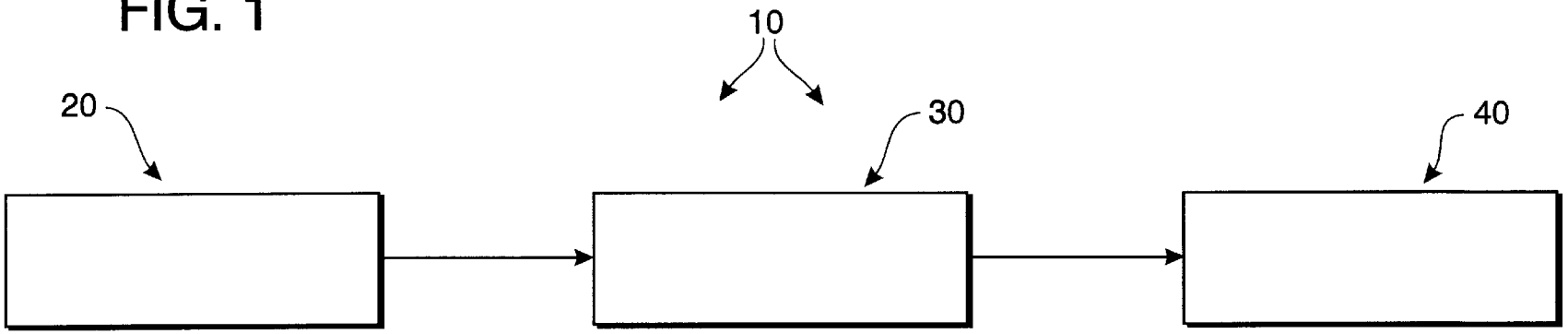
FIG. 1 is a process schematic of an exemplary embodiment of the invention; and, FIG. 2 is a process schematic of another embodiment of the invention.
Figure 2:
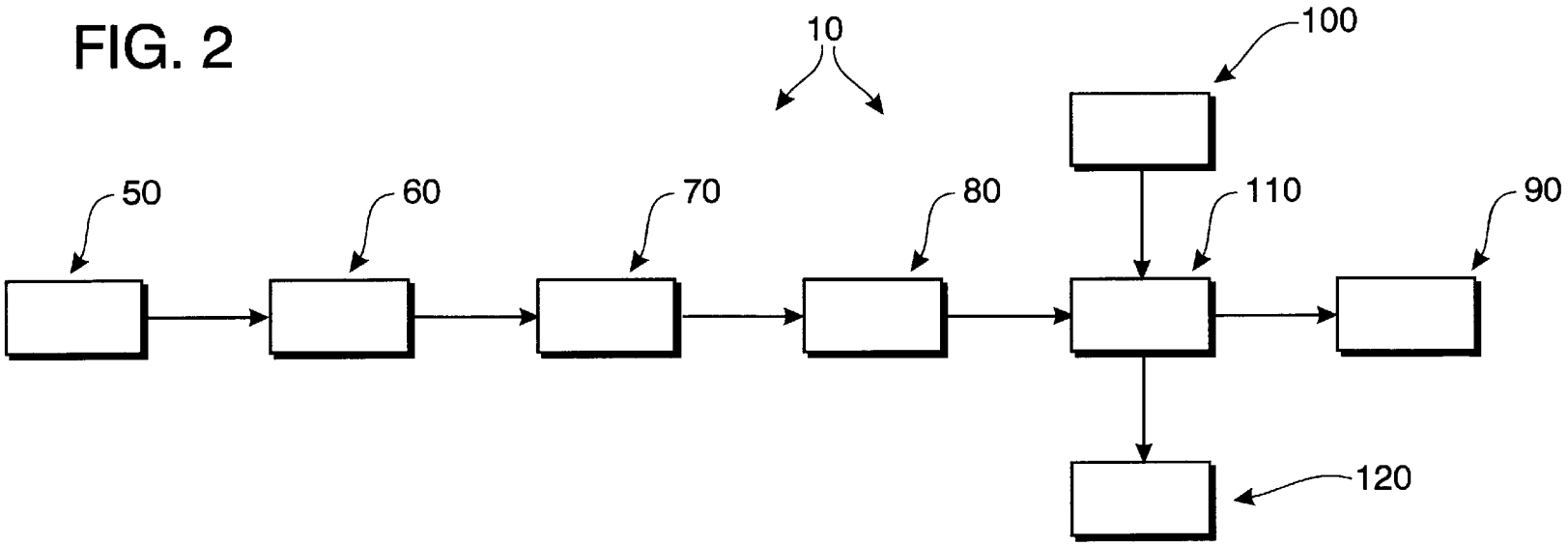

The process is generally designated by reference numeral 10 in FIGS. 1 and 2. The process uses several steps to substantially obscure and/or alter the printed materials on a page. The steps may be summarized as arranging the materials to be treated (20), treating the materials (30) and subsequently drying the materials (40). Optional intermediate steps that may be included after materials treatment include further distortment of any remaining ink on the material, using alternative materials to "blot" the treated material as well as producing additional re-usable pages from optional cross-stream treatments.

As mentioned herinabove, the pages are first arranged to receive treatment during the initial step. This initial step (represented by box 20 in FIG. 1) may require a preliminary treatment involving the removal of independent pages from a bound item, such as separating the pages from a magazine or the like. Such preliminary treatments are conventionally known and many conventional tools, such as cutters, collators, and the like are commercially available and perfectly acceptable for use in this manner. The primary purpose of the arrangement step is to align the materials to be treated such that the paper to be treated is accessible for the subsequent application of an activator.

The treatment step includes the application of an activator to the page and the subsequent alteration of the ink. Ideally, the treatment step includes the use of an organic, biodegradable and non-toxic activator such as CITRA-SOLV®, a non-toxic citrus-based cleaning solution that is manufactured by Shadow Lake, Inc., located in Ridgefield, Conn. However, acceptable alternate activators are commercially available such as KWIK-KLEEN®, a product manufactured by Anchor, Inc., located in Orange Park, Fla.

The activator is applied to the arranged papers in a suitable manner. The method of application may include misting, wiping, spraying, etc. The primary concern is that the activator is applied sufficiently to the material to initiate the solubilization of the ink in order to permit subsequent alteration of the preexisting pattern on the paper, yet not saturate paper fibers.

The alteration of the ink upon the material is accomplished by physically contacting the material with an appropriate tool or blotter to distort and/or disturb the activated ink to alter the preexisting pattern upon the page (represented by box 30 in FIG. 1).

Tools that may be used include plastic bags, plastic brushes, strings, nylon strings and the like. The tools are preferably deployed in close proximity to the path of paper after application of the activator in order to quickly work upon the pattern to be altered. The primary object in the treatment step is to substantially alter the preexisting pattern upon the page so that the original pattern is no longer recognizable. In this manner, the paper may be re-used without liability for copyright and/or trademark infringement. The paper is enhanced in its decorative value as a result of the alteration. The activated solubilized ink combines to form new and attractive patterns. As another optional step, new ink may be added to obtain desirable color schemes.

After the alteration step, an optional cross-stream blotting step can be employed to maximize the use of solubilized ink. In this manner, the ink may be re-used as well, thus preventing the unnecessary expense associated with purchasing and printing. This is particularly effective when a second, blank paper is pressed against the treated material.

The drying step (represented by box 40 in FIG. 1) permits the treated material to set the solubilized ink to fix the altered pattern on the treated paper. This step can be carried out using conventional air blowers to decrease the requisite time required to dry the ink by simply allowing the material to rest until dry, which can be accomplished in minutes without the use of dryers or heaters.

The following steps can be employed by an individual to utilize the teachings of the invention and are broadly represented by FIG. 1. This example is for illustrative purposes only and is not intended to limit the scope of the present invention.

Step 1: Begin by removing pages from magazines; simply tearing them out is fine. While darker or richer colors work better, any page can be used and even text can be used creatively.

Step 2: The pages are then arranged to form a work surface. Some paper requires alteration on both sides, while some papers may only require alteration on one side. Concentrated CITRA-SOLV®, a non-toxic citrus-based cleaning solution manufactured by Shadow Lake, Inc., located in Ridgefield, Conn. is preferably used as an activator. In CITRA-SOLV®, the active ingredient is limonene and it is believed responsible for solubilizing the ink. It is believed that other cleaners and the like with this chemical will work acceptably as an activator. The activator is either sprayed onto the paper or a few drops are applied across the surface to be treated. A small scrubber (like those used to wash dishes) is then used to work the activator into the page and the ink to dissolve the image. It is important to work most thoroughly on "text" and then on the edges of recognizable shapes. Large areas of solid color need not be worked heavily. After the ink is distorted sufficiently to alter the pre-existing pattern acceptably, which generally takes less than a minute, the paper is dried. Alternatively, another piece of paper may be placed on top of the still wet first sheet and then the surfaces are patted together.

Step 3: The paper is permitted to dry to set the altered pattern. If a blotting sheet has been used, the sheets are peeled apart to permit the first sheet to dry. The drying time is normally 5 to 10 minutes. Fans or other air dryers can be used to decrease the drying time.

As an optional step, items such as string and thread can be placed on the first sheet prior to putting the second blotting sheet on. This can give some very interesting patterns. Plastic bags or food wrapping plastic can be used as a blotter. This can be pressed onto the still wet sheet and lifted off over a large area or in small repeated pattern. Gloved fingertips can give interesting results, as can smearing the ink.

As another example, the following steps can be employed to execute the invention on a larger scale and are represented by FIG. 2. This example is by way of illustration only and is not intended to limit the scope of the invention in any manner.

Step 1: The materials are selected and pre-treated by removing individual pages from magazines using shears, cutters, and the like as indicated by box 50 in FIG. 2. The pages are then collated into a suitable feed arrangement in a known and conventional manner. After being deployed into the feed arrangement, the papers may then be fed onto a conventional conveyor or the like.

Step 2: The papers are fed onto the conveyor in individual sheets so that each paper to be treated is accessible as indicated by box 60. As the papers are fed upon the conveyor, they are appropriately spaced in approximately ¼ to 1 inch increments since some room is needed for overspray and the like, and to prevent jamming and the like. The papers on the conveyor are then fed into an application booth.

Step 3: The application booth comprises a substantially shielded structure in which the activator is applied to the paper to be treated and it is represented by box 60. The applicator may utilize spraying, misting, wiping or other similar application techniques. The booth prevents overspray while also serving to prevent accidental contamination of previously treated materials and the like. In another alternative embodiment, the papers may feed through a sponge applicator. In a preferred embodiment, the activator is a biodegradable, non-toxic substance (i.e. CITRA-SOLV®,) so that exposure to persons does not generally cause adverse affects, although overexposure should be avoided.

Step 4: Following application of the activator to the paper, the paper is conveyed to an intermediate position so that the activator may have an appropriate time to initiate ink solubilization as represented by box 70. Once the ink has suitably solubilized, the paper may be further treated to alter the ink, generally within 30 seconds to one minute.

Step 5: The ink is altered by physically contacting the solubilized ink with a working tool such as a brush, non-repeating sanders or brushes, plastic line, nylon string, wire brush, plastic bag, plastic brush, or the like as represented by box 80. The conveyor upon which the paper rests may pass beneath the selected tool and/or combinations of tools as desirable. Other contrivances are possible so long as the tool contacts the paper sufficiently to alter the pre-existing pattern by distorting and/or otherwise moving the solubilized ink.

Step 6: The treated paper with the altered ink is permitted to dry as represented by box 90. It may be air dried or the drying process may be expedited by the application of blown air or heat to the paper. If heat is used, caution must be exercised to insure that the paper does not combust.

In an optional configuration (after step 5 and prior to step 6), a cross-stream may be utilized to further dry and/or blot and/or alter the pre-existing pattern of ink to re-use the solubilized ink (represented by boxes 100, 110, 120). In this configuration, the cross-stream intersects the conveyor upon which the altered paper is travelling. Using conventional techniques, the cross-section material is pressed or blotted against the altered paper to absorb a portion of the solubilized ink. The cross-stream material may be untreated, blank paper or paper to be treated for reclamation. Thus, the cross-stream could be used as an initial treatment step to maximize usage of the activator and ink recovery as well.

Whereas, the present invention has been described in relation to the drawings attached hereto, it should be understood that other and further modifications, apart from those shown or suggested herein, may be made within the spirit and scope of this invention.

What is claimed is:

1. A process for reclaiming waste paper for subsequent re-use, said process comprising the steps of:

treating said waste paper to be reclaimed by first arranging said paper in an orientation to expose a pre-existing pattern formed by ink on said paper for subsequent alteration;

applying an activator to said pre-existing pattern to solubilize said pattern forming ink and then physically contacting said solubilized ink to substantially alter said pre-existing pattern formed by said ink to create a distorted pattern to alter said paper;

adding additional ink to said solubilized ink to further alter said pre-existing pattern; and, drying said treated paper to set said solubilized ink in said altered pattern.

2. A process for reclaiming waste paper for subsequent re-use, said process comprising the steps of:

treating said waste paper to be reclaimed by first arranging said paper in an orientation to expose a pre-existing pattern formed by ink on said paper for subsequent alteration;

applying an activator to said pre-existing pattern solubilize said pattern forming ink and then physically contacting said solubilized ink to substantially alter said pre-existing pattern formed by said ink to create a distorted pattern to alter said paper;

adding additional ink to said solubilized ink to further distort said pre-existing pattern;

drying said altered paper to set said solubilized ink in said distorted pattern; and, wherein said activator comprises a non-toxic biodegradable chemical solvent.

3. A process for reclaiming waste paper for subsequent re-use, said process comprising the steps of:

treating said waste paper to be reclaimed by first arranging said paper in an orientation to expose a pre-existing pattern formed by ink on said pattern for subsequent alteration;

applying a non-toxic biodegradable chemical solvent activator to said pre-existing pattern to solubilize ink and then physically contacting said solubilized ink to substantially alter any pre-existing patterns formed by said ink to create a distorted pattern to alter said paper;

adding additional ink to said solubilized ink to further distort said pre-existing pattern; and, drying said treated paper to set said solubilized ink in said altered pattern; and, wherein said step of physically contacting said paper to be treated further comprises manipulating said paper with a tool adapted to move said solubilized ink, said tool selected from the group consisting of brushes, strings, filaments, other paper products, plastic and bags.

* * * * *